United States Patent [19]

Reese et al.

[11] 4,284,417

[45] Aug. 18, 1981

[54] METHOD FOR CONTROLLING ELECTRIC POWER SUPPLIED TO CORONA GENERATING ELECTRODES IN AN ELECTROSTATIC PRECIPITATOR

[75] Inventors: Robert O. Reese, Lancaster; Karl R. Wieber, Middletown; James A. Sholly, Lebanon, all of Pa.

[73] Assignee: Envirotech Corporation, Menlo Park, Calif.

[21] Appl. No.: 130,642

[22] Filed: Mar. 17, 1980

[51] Int. Cl.[3] ..... B03C 3/68

[52] U.S. Cl. ..... 55/2; 55/105; 55/139

[58] Field of Search ..... 55/4, 18, 105, 139, 55/270, 2; 361/235; 356/72, 438; 250/564, 565

[56] References Cited

U.S. PATENT DOCUMENTS

| | | | |
|---|---|---|---|
| 3,237,375 | 3/1966 | Schwarz et al. | 55/4 |
| 3,407,692 | 10/1968 | Martin, Jr. | 356/72 |
| 3,487,225 | 12/1969 | Button | 250/565 |
| 3,630,617 | 12/1971 | Marrett et al. | 356/72 |
| 3,711,210 | 1/1973 | Krukowski | 356/438 |
| 3,745,749 | 7/1973 | Gelfand | 55/105 |
| 3,879,135 | 4/1975 | Egli et al. | 250/565 |
| 3,893,828 | 7/1975 | Archer | 55/139 |
| 3,993,460 | 11/1976 | Gooch et al. | 55/270 |
| 4,084,906 | 4/1978 | Bibbero | 250/565 |
| 4,155,725 | 5/1979 | Ackeren et al. | 55/270 |
| 4,160,246 | 7/1979 | Martin et al. | 356/438 |

*Primary Examiner*—David L. Lacey

*Attorney, Agent, or Firm*—Robert E. Krebs; T. J. McNaughton

[57] ABSTRACT

In a system for controlling electric power supplied to corona-generating electrodes in an electrostatic precipitator (10), an opacity-sensitive transducer (20) produces an output signal proportional to the opacity of the flue gas exiting from the precipitator (10). The signal from the transducer (20) is compared in comparators (304 and 305) with pre-set upper and lower limits defining a permissible opacity range for the flue gas. When the signal from the transducer (20) exceeds the pre-set upper limit or falls below the pre-set lower limit, automatic voltage controllers (40) are activated to control the power supplied to the corona-generating electrodes in order to restore the flue gas opacity to the permissible opacity range.

6 Claims, 3 Drawing Figures

METHOD FOR CONTROLLING ELECTRIC POWER SUPPLIED TO CORONA GENERATING ELECTRODES IN AN ELECTROSTATIC PRECIPITATOR

BACKGROUND OF THE INVENTION

1. Field of the Invention

This invention pertains to the control of energy consumption in an electrostatic precipitator.

More particularly, this invention pertains to method and apparatus for continuously and automatically regulating electric power supplied to the corona generating electrodes of an electrostatic precipitator in response to changes in opacity of the flue gas exiting from the precipitator.

2. State of the Art

Control circuitry illustrative of the prior art for energizing the corona generating electrodes of an electrostatic precipitator is described in U.S. Pat. No. 3,745,749. A more recent automatic voltage control system for energizing the corona generating electrodes of an electrostatic precipitator is described in copending U.S. patent application Ser. No. 06/041,965 filed on May 23, 1979, which application is owned by the assignee of the present application.

It has been customary for the corona generating electrodes of an electrostatic precipitator to be powered at the highest voltage practicable in order to achieve maximum electric field strength between the corona generating electrodes and the particulate collecting electrodes. Power control techniques for electrostatic precipitators have heretofore been primarily concerned with providing rapid response to sparking conditions, so that power can be shut OFF or reduced below sparking potential promptly after the occurrence of a spark, and reapplied (preferably in a "fast ramp" manner to reach a predetermined level below a selected voltage control value) in a matter of milliseconds after the spark has occurred.

In the prior art, power control techniques for electrostatic precipitators have not been used primarily to control energy consumption. Accordingly, no technique has heretofore been developed for continuously and automatically varying the voltage applied to the corona generating electrodes of an electrostatic precipitator in order to minimize the electric power consumed in removing particulates from the gas stream passing through the precipitator.

OBJECT OF THE INVENTION

It is an object of the present invention to provide a technique for controlling energy consumption in an electrostatic precipitator.

It is a particular object of the present invention to provide a technique for continuously and automatically regulating the electric power supplied to the corona generating electrodes of an electrostatic precipitator to meet a precise pollution control standard for the flue gas exiting from the precipitator.

It is a more particular object of the present invention to regulate the electric power supplied to the corona generating electrodes of an electrostatic precipitator continuously and automatically in response to changes in opacity of the flue gas exiting from the precipitator.

The opacity of the flue gas exiting from an electrostatic precipitator is a measure of the magnitude of the particulate burden carried by the flue gas, which is in turn a measure of the effectiveness of the precipitator in removing particulates from the gas stream entering the precipitator. In accordance with the present invention, an opacity transducer is exposed to the flue gas exiting from an electrostatic precipitator to generate a dynamic signal indicative of flue gas opacity. The output from the opacity transducer is a current signal, which is converted to a time-integrated analog voltage signal, which in turn is converted to a digital signal that is compared with pre-set high and low opacity limits defining the desired opacity range for the flue gas. If the opacity level of the flue gas exceeds the high opacity limit, voltage control circuitry is automatically activated to increase the electric power supplied to the corona generating electrodes. If the opacity level of the flue gas falls below the low opacity limit, the voltage control circuitry is automatically activated to decrease the electric power supplied to the corona generating electrodes.

Automatic voltage control systems for use in practicing the present invention are commercially available. In particular, use of the AVCON 2000 automatic voltage control system developed by the Buell Emission Control Division of Envirotech Corporation, Lebanon, Pennsylvania, is contemplated.

In a precipitator having a plurality of separately energizable fields of corona generating electrodes, a separate automatic voltage controller is provided for each field of electrodes. Each automatic voltage controller is individually responsive to the opacity indicative signal, so that electric power supplied to each of the various electrode fields can be independently controlled.

With the present invention, an electrostatic precipitator can be "fine tuned" so that electric power consumption is minimized, while compliance with the precise pollution control standard established for the precipitator by governmental or other regulatory agencies can be assured.

DESCRIPTION OF THE PREFERRED EMBODIMENT

Figure 1:
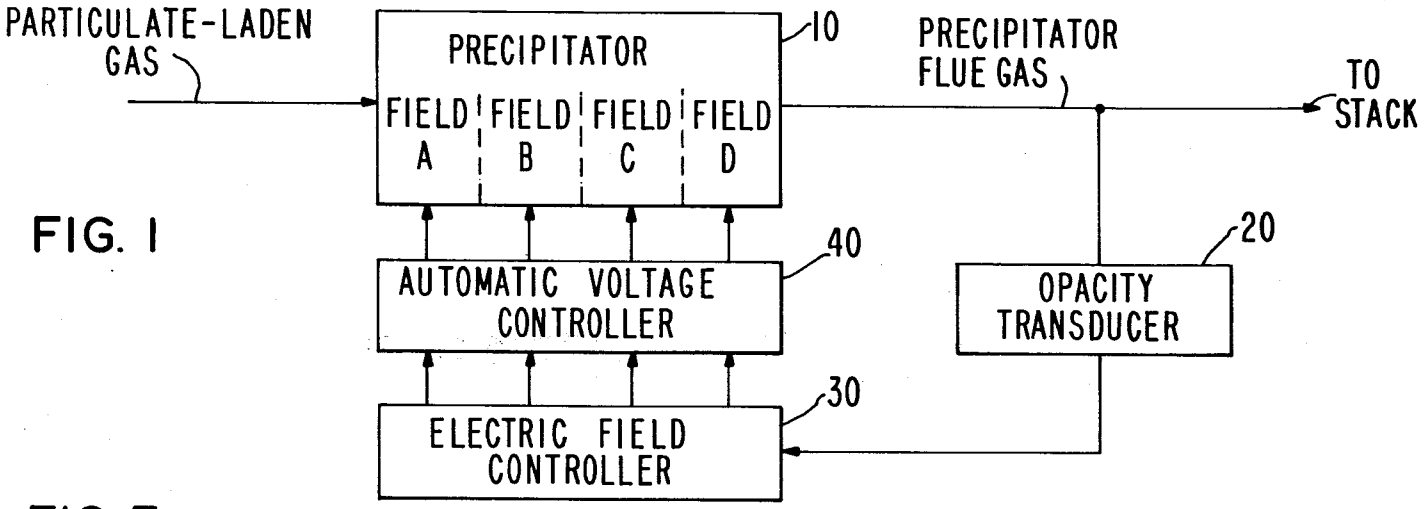
FIG. 1 is a functional block diagram of an electric power control system according to the present invention.

In an electric power control system as shown in FIG. 1, a particulate-laden stream of gas (e.g., the exhaust gas from a coal-fired furnace) is passed through an electrostatic precipitator 10. The precipitation 10 may be of conventional design, and preferably has a plurality of independently energizable fields of corona generating electrodes (indicated in the drawing as fields A, B, C and D) suspended therein.

As the particulate-laden gas stream passes through the corona regions established by the corona generating electrodes in the precipitator 10, electric charge is imparted to the particulates in the gas stream. The charged particulates are then electrostatically attracted to collecting electrode structures, typically electrically grounded plates, suspended in the precipitator 10. In this way, the particulates are removed from the gas stream by deposition onto the collecting electrode structures. The gas stream, cleansed in significant part of its burden of particulates, then exits from the precipitator 10 as flue gas to a stack.

The opacity of the flue gas exiting from the precipitator 10 is a direct measure of the effectiveness of the precipitator 10 in removing particulates from the gas stream. An exceedingly high opacity value for the flue gas indicates inadequate removal of particulates from the gas stream passing through the precipitator 10.

In accordance with the present invention, an opacity transducer 20 is disposed to monitor the opacity of the flue gas exiting from the precipitator 10, and to generate a dynamic signal proportional to the opacity level of the flue gas. The opacity level signal serves as input to electric field controller circuitry 30 that generates individual input signals to a plurality of automatic voltage controllers 40, each of which independently controls the electric power supplied to a corresponding one of the fields A, B, C and D of corona generating electrodes in the precipitator 10.

The opacity transducer 20 generates an analog output signal (e.g., a current signal in the 0 to 20 milliampere range) proportional to the opacity of the flue gas exiting from the precipitator 10. This analog current signal is dynamically variable in response to opacity fluctuations caused by changes in the concentration of particulates in the gas stream entering the precipitator 10. As changes occur in the concentration of particulates in the gas stream, corresponding changes are required in the electric power supplied to the corona generating electrodes (or to particular fields of corona generating electrodes) in the precipitator 10 in order to maintain the precise electric field strength needed to charge the particulates in the gas stream at the most economical level of energy consumption.

Figure 2:
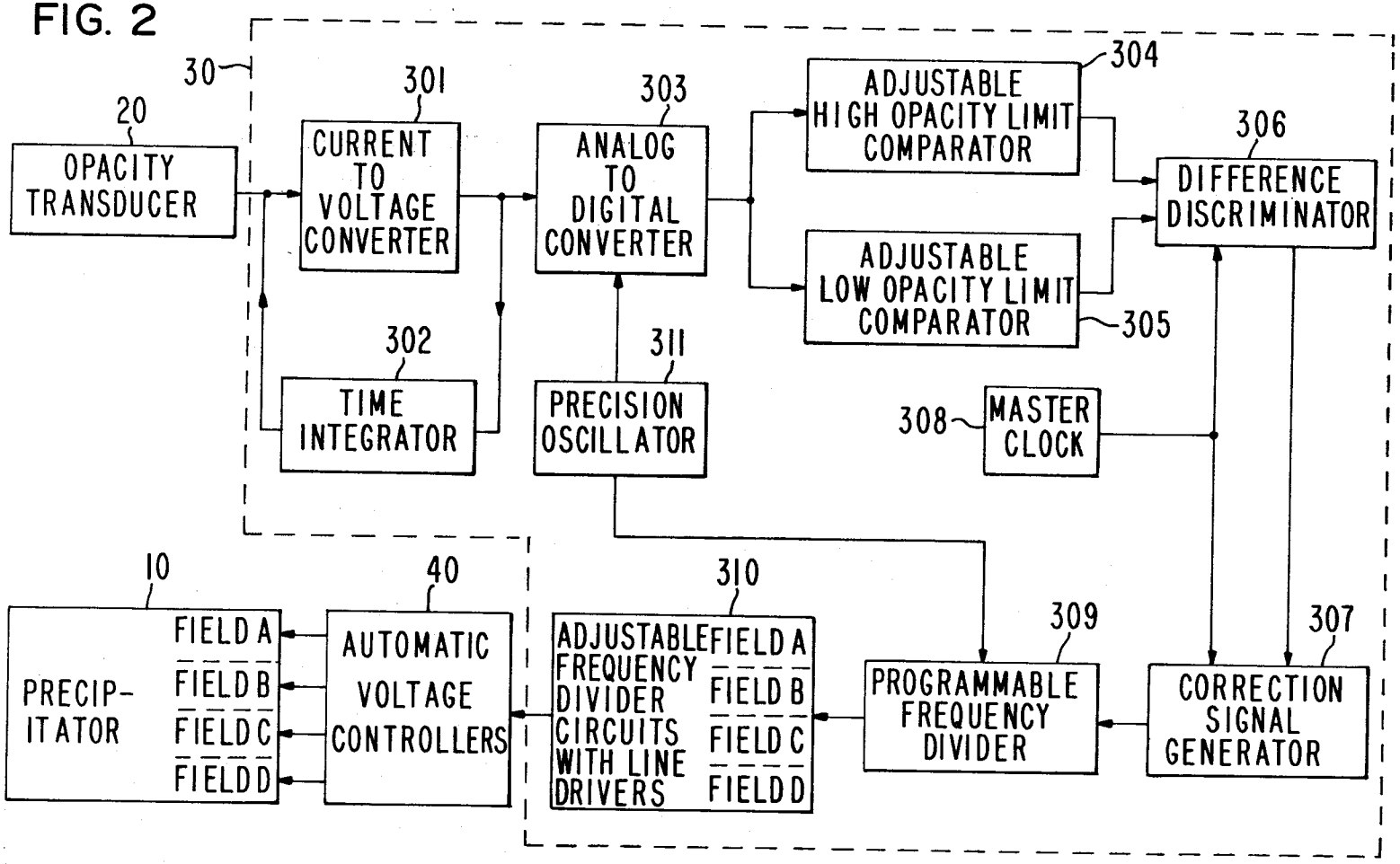
FIG. 2 is a functional block diagram of the electric field controller of the power control system shown in FIG. 1.

With reference to FIG. 2, the analog current signal from the opacity transducer 20 is converted to a proportional analog voltage signal by a current-to-voltage converter 301. This analog voltage signal (e.g., a signal in the 0 to 10 volt range) is integrated by a time integrator 302 over a sufficiently long time interval to accommodate transient changes in flue gas opacity without causing corresponding transient activation of the electric field controller circuitry 30. The integrated analog voltage signal is then converted to a digital signal (e.g., an 8-bit digital word) by an analog-to-digital converter 303. This digital signal is then compared to a pre-set high opacity limit in an adjustable 8-bit magnitude comparator 304, and to a pre-set low opacity limit in a corresponding adjustable 8-bit magnitude comparator 305. The high and low opacity limits are selectable according to the particular pollution control standard that the precipitator 10 is required to maintain, so that a desired opacity range for the flue gas exiting from the precipitator 10 can be defined.

The high opacity limit set for the comparator 304 might correspond, for example, to a selected value below the maximum flue gas opacity level permitted by a pollution control regulatory agency. The low opacity limit set for the comparator 305 corresponds to a lower flue gas opacity level, which is sufficiently below the maximum permitted level to justify reducing the electric power supplied to the corona generating electrodes. Distribution of electric power to the various fields of corona generating electrodes in an electrostatic precipitator is referred to in the art as "profiling" the precipitator. According to the present invention, the precipitator 10 is profiled to maintain a flue gas opacity level within the range defined by the high and low opacity limits set for the adjustable comparators 304 and 305, respectively. Once having been selected, the high and low opacity limits set for the comparators 304 and 305, respectively, remain constant until some new consideration (e.g., a change in the air pollution standard) requires re-adjustment of the limits.

If the opacity level of the flue gas exceeds the high opacity limit, the electric field controller circuitry 30 generates appropriate signals to increase the electric power supplied to some or all of the fields of corona generating electrodes in the precipitator 10. If the opacity level of the flue gas neither exceeds the high limit nor is less than the low limit, the electric power supplied to the corona generating electrodes is held constant. If the opacity level of the flue gas falls below the low limit, the electric field controller circuitry 30 generates appropriate signals to decrease the electric power supplied to some or all of the fields of corona generating electrodes. In this way, the electric power supplied to the corona generating electrodes can be dynamically controlled to meet the changing power needs of the precipitator 10 for maintaining a desired level of particulate filtration.

Profiling techniques per se are not part of the present invention, and are within the routine competence of those skilled in the art. The present invention, however, enables the profiling of an electrostatic precipitator to be varied continuously and automatically during operation.

More particularly, with further reference to FIG. 2, the comparators 304 and 305 are gated to a difference discriminator 306 by conventional means. The outputs from the comparators 304 and 305 are binary digital signals that indicate opacity level of the flue gas with respect to the pre-set high and low opacity limits. The difference discriminator 306 comprises a logic gating circuit whose output is determined by the frequency of a master clock 308. When the flue gas opacity is within the range defined by the high and low opacity limits, the difference discriminator 306 produces a digital HOLD signal that causes the electric field controller circuitry 30 to maintain unchanging input signals to the automatic voltage controllers 40. However, when the outputs from the comparators 304 and 305 indicate that the opacity of the flue gas is outside the desired range defined by the high and low opacity limits, the difference discriminator 306 produces a digital output signal indicating the magnitude and sense by which the opacity of the flue gas is greater than the high limit or less than the low limit. A non-null output from the difference discriminator 306 causes the electric field controller circuitry 30 to change the profile of the corona generating electrode fields in the precipitator 10 so as to maintain the most economical distribution of electric power to the corona generating electrodes.

The output signal from the difference discriminator 306 activates a correction signal generator 307 to produce a digital signal (an 8-bit word), which causes a programmable frequency divider 309 to increase or decrease its output frequency. In the preferred embodiment, the correction signal generator 307 is an up/down counter whose counting rate is determined by the frequency of the master clock 308; and the output of the difference discriminator 306 determines whether the correction signal generator 307 operates in a count-up, count-down or no-count mode.

When the difference discriminator 306 produces a HOLD signal, the correction signal generator 307 causes the programmable frequency divider 309 to activate adjustable frequency divider circuits 310 that control the automatic voltage controllers 40 so as to distribute electric power to the individual fields of corona generating electrodes in the precipitator 10 according to a basic profiling schedule. When the difference discriminator 306 produces a signal indicating that the flue gas opacity is outside the range defined by the high and low opacity limits, the correction signal generator 307 causes the programmable frequency divider 309 to adjust appropriate frequency divider circuits 310 to control the automatic voltage controllers 40 so as to distribute electric power most efficiently to the corona generating electrode fields in such a way as to restore the flue gas opacity to a level within the acceptable opacity range.

In the preferred embodiment, the programmable frequency divider 309, which is gated to a plurality of individually adjustable frequency divider circuits 310, is driven by a precision oscillator 311 that also drives the analog-to-digital converter 303. In this way, accurate analog-to-digital conversion is provided and stable operation of the automatic voltage controllers 40 is obtained. Each one of the frequency divider circuits 310 corresponds to a particular one of the fields of corona generating electrodes in the precipitator 10, and each of the frequency divider circuits 310 can be individually adjusted by the precipitator operator.

The output signal from the frequency divider 309 is a variable frequency signal in the 0 to 10 kilohertz range, and is transmitted by line drivers associated with the frequency divider circuits 310 to the automatic voltage controllers 40 in order to supply power automatically at a dynamically optimized rate to each of the various fields A, B, C and D of corona generating electrodes in the electrostatic precipitator 10. The automatic voltage controllers 40 are preferably as described in, which application is owned by the assignee of the present application co-pending U.S. patent application Ser. No. 06/041,965.

In the preferred embodiment, in the event the signal from the opacity transducer 20 is momentarily interrupted (e.g., for calibration purposes or because of accidental disruptions), the electric field controller circuitry 30 is designed to retain the most recent output signal from the difference discriminator 306 falling within the high and low opacity limits so as to cause the automatic voltage controllers 40 to operate at that most recent signal until an output signal from the opacity transducer 20 re-appears or until the precipitator operator intervenes to shut power OFF. In this way, stable operation of the precipitator 10 can be assured during momentary interruptions of the signal from the opacity transducer 20.

Figure 3:
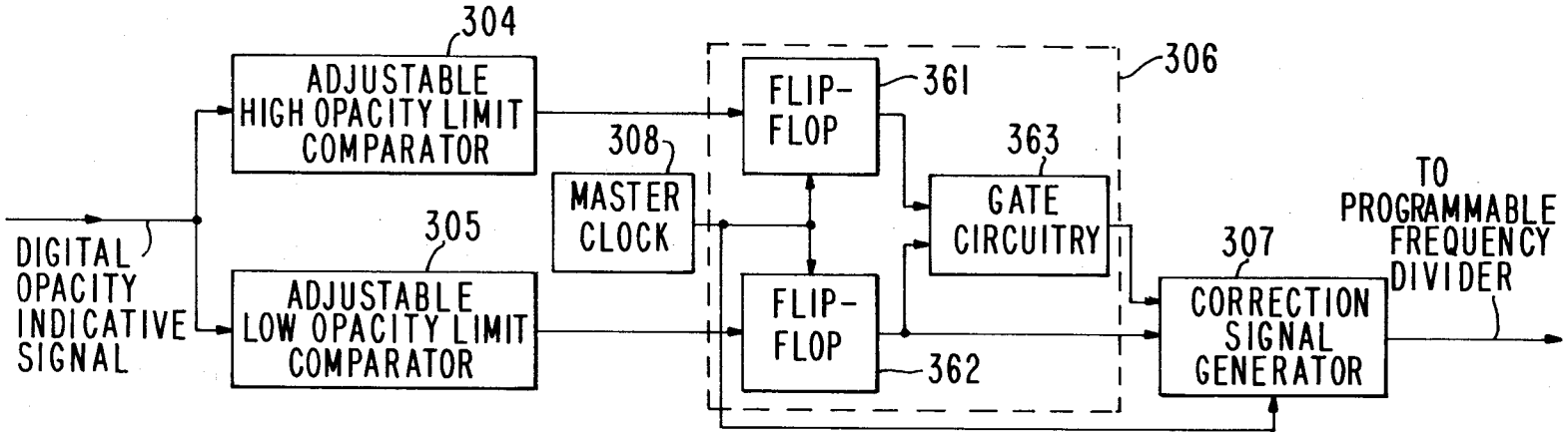
FIG. 3 is a functional block diagram of the difference discriminator of the electric field controller shown in FIG. 2.

With reference to FIG. 3, the operation of the difference discriminator 306 can be explained as follows. The output of the high opacity limit comparator 304 is latched to the frequency of the master clock 308 in a flip-flop 361, which is enabled to receive the output of the comparator 304 during periodic intervals as determined by the falling edges of the clock frequency signal. Similarly, the output of the low opacity limit comparator 305 is latched to the frequency of the master clock 308 in a flip-flop 362, which is enabled to receive the output of the comparator 305 during the same periodic intervals as determined by the falling edges of the clock frequency signal. Latching of the outputs of the comparators 304 and 305 to the frequency of the master clock 308 prevents erroneous counting of the up/down counter comprising the correction signal generator 307 that might otherwise occur when the comparators 304 and 305 change state.

In order to prevent erroneous reductions in power supplied to the automatic voltage controllers 40, the up/down counter of the correction signal generator 307 is pre-set to zero when power is first supplied to the electric field controller 30. Otherwise, the up/down counter might tend to exceed its maximum count in the UP mode or its minimum count in the DOWN mode. The flip-flops 361 and 362 provide binary digital outputs, which are gated by conventional gate circuitry 363 to the correction signal generator 307. The output from the flip-flop 361 is passed via the gate circuitry 363 to the correction signal generator 307; and the output from the other flip-flop 362 is passed both directly and also via the gate circuitry 363 to the correction signal generator 307. The output from the gate circuitry 363 determines whether the signal from the opacity transducer 20 is between the high and low opacity limits set by the operator.

The present invention has been described above in terms of particular electronic circuit components. However, other functionally equivalent circuit components for implementing the present invention could be utilized by workers skilled in the art, and yet be within the purview of the present invention. The scope of the invention is to be construed from the following claims and their equivalents.

What is claimed is:

1. A method for controlling electric power supplied to corona generating electrodes in an electrostatic precipitator, said method comprising the steps of:

(a) generating a signal indicative of the opacity level of flue gas exiting from said precipitator;

(b) comparing said opacity level signal with selectable upper and lower limits, said limits defining a permissible opacity range for said flue gas; and (c) activating control circuitry for causing the electric power supplied to said corona generating electrodes to increase when said opacity level signal exceeds said upper limit and to decrease when said opacity level signal falls below said lower limit.

2. The method of claim 1 wherein the step of generating a signal indicative of the opacity level of said flue gas comprises generating an output signal from an opacity-sensitive transducer, and wherein the step of comparing said opacity level signal with said upper and lower limits comprises comparing said output signal from said opacity-sensitive transducer with a pre-set upper limit in a high-limit comparator and with a preset lower limit in a low-limit comparator.

3. The method of claim 2 wherein said opacity-sensitive transducer produces an analog output signal, which is integrated over a sufficient time interval to accommodate transient changes in flue gas opacity without causing corresponding transient activation of said control circuitry.

4. The method of claim 3 wherein the step of activating said control circuitry comprises:

(a) generating dynamic correction signal proportional to the deviation of said opacity level signal from an opacity range defined by said upper and lower limits; and (b) coupling said dynamic correction signal as input to said control circuitry.

5. The method of claim 1 wherein said corona generating electrodes are grouped into a plurality of separately energizable fields of electrodes, said fields being disposed in succession along the flow path of particulate-laden gas flowing through said precipitator, and where the step of activating said control circuitry comprises selectively varying the electric power supplied to any one of said fields of corona generating electrodes.

6. A method for controlling energy consumption in an electrostatic precipitator by monitoring opacity of flue gas from said precipitator, said method comprising the steps of:

(a) increasing electric power supplied to corona generating electrodes of said precipitator when the opacity of said flue gas increases above a predetermined high value, and (b) decreasing electric power supplied to said corona generating electrodes when the opacity of said flue gas decreases below a predetermined low value.

* * * * *